United States Patent [19]

Dellinger

[11] 4,428,441

[45] * Jan. 31, 1984

[54] METHOD AND APPARATUS FOR REDUCING THE DIFFERENTIAL PRESSURE STICKING TENDENCY OF A DRILL STRING

[75] Inventor: Thomas B. Dellinger, Duncanville, Tex.

[73] Assignee: Mobil Oil Corporation, New York, N.Y.

[ * ] Notice: The portion of the term of this patent subsequent to Jan. 27, 1998 has been disclaimed.

[21] Appl. No.: 223,464

[22] Filed: Jan. 8, 1981

Related U.S. Application Data

[63] Continuation-in-part of Ser. No. 26,844, Apr. 4, 1979, Pat. No. 4,246,975.

[51] Int. Cl.[3] ..... E21B 7/08; E21B 17/02

[52] U.S. Cl. ..... 175/61; 175/76; 175/325

[58] Field of Search ..... 175/320, 323, 325, 61, 175/76; 308/4 A

[56] References Cited

U.S. PATENT DOCUMENTS

| | | | |
|---|---|---|---|
| 3,146,611 | 9/1964 | Fox | 175/320 X |
| 3,237,427 | 3/1966 | Scarborough | 175/320 X |
| 3,267,695 | 8/1966 | Toelke | 175/320 X |
| 3,382,938 | 5/1968 | Williams, Jr. | 175/76 X |
| 3,525,237 | 8/1970 | Lari | 175/320 X |
| 4,246,975 | 1/1981 | Dellinger | 175/325 X |

FOREIGN PATENT DOCUMENTS

| | | | |
|---|---|---|---|
| 564188 | 2/1958 | Belgium | 175/320 |
| 404589 | 12/1965 | Switzerland | 175/320 |

*Primary Examiner*—Stephen J. Novosad

*Attorney, Agent, or Firm*—A. J. McKillop; M. G. Gilman; J. F. Powers, Jr.

[57] ABSTRACT

A method for reducing the sticking tendency of a rotating drill string in its drill cuttings and the surrounding wall cake by constructing the drill string elements, such as the tool joints, drill collars, wear knots, etc. with noncircular cross-sectional shapes. The noncircular shapes may be triangular, square or other higher order multi-faceted shapes, or elliptical, etc. Rotation of the drill string causes a periodic opening to form between the noncircular elements and the cuttings and wall cake which results in a movement of the mass of solids around the noncircular elements to positions away from the drill string, thereby mitigating the tendency of the drill string to differentially stick. Further, hydraulic seals are also likely to be broken by the reciprocating action of the noncircular elements.

6 Claims, 9 Drawing Figures

METHOD AND APPARATUS FOR REDUCING THE DIFFERENTIAL PRESSURE STICKING TENDENCY OF A DRILL STRING

CROSS-REFERENCE TO RELATED APPLICATIONS

This application is a continuation-in-part of co-pending application Ser. No. 026,844, filed Apr. 4, 1979, for "Wellbore Drilling Technique Using Eccentric Tool Joints to Mitigate Pressure-Differential Sticking", now U.S. Pat. No. 4,246,975. Application Ser. No. 26,844 is incorporated herein by reference.

BACKGROUND OF THE INVENTION

1. Field of the Invention

The present invention relates generally to a rotary drilling arrangement for mitigating pressure-differential sticking of a drill string in a wellbore. More particularly, the subject invention concerns a method and apparatus for drilling deviated wellbores, such as in extended reach drilling, which are particularly designed to reduce the chance of pressure-differential sticking of the drill string in the wellbore.

Extended Reach Drilling is concerned with rotary drilling procedures to drill, log and complete wellbores at significantly greater inclinations and/or over horizontal distances substantially greater than currently being achieved by conventional directional drilling practices. The success of extended reach drilling should benefit mainly offshore drilling projects as platform costs are a major factor in most offshore production operations. Extended reach drilling offers significant potential for (1) developing offshore reservoirs not otherwise considered to be economical, (2) tapping sections of reservoirs presently considered beyond economical or technological reach, (3) accelerating production by longer intervals in the producing formation due to the high angle holes, (4) requiring fewer platforms to develop large reservoirs, (5) providing an alternative for some subsea completions, and (6) drilling under shipping fairways or to other areas presently unreachable.

A number of problems are presented by high angle extended reach directional drilling. In greater particularity, hole inclinations of 60° or greater, combined with long sections of hole or complex wellbore profiles present significant problems which need to be overcome in extended reach drilling. The force of gravity, coefficients of friction, and mud particle settling are the major physical phenomena of concern.

As inclination increases, the available weight from gravity to move the pipe or wireline string down the hole decreases as the cosine of the inclination angle, and the weight lying against the low side of the hole increases as the sine of the inclination angle. The force resisting the movement of the drill string is the product of the apparent coefficient of friction and the sum of the forces pressing the string against the wall. At an apparent coefficient of friction of approximately 0.58 for a common water base mud, drill strings tend to slide into the hole at inclination angles up to approximately 60°. At higher inclination angles, the drill strings will not lower from the force of gravity alone, and must be mechanically pushed or pulled, or alternatively the coefficients of friction can be reduced. Since logging wirelines cannot be pushed, conventional wireline logging is one of the first functions to encounter difficulties in this type of operation.

Hole cleaning also becomes more of a problem in high angle bore holes because particles need fall only a few inches to be out of the mud flow stream and to come to rest on the low side of the hole, usually in a flow-shaded area alongside the pipe. This problem is also encountered in substantially vertical wellbores but the problem is much worse in deviated wellbores. In deviated wellbores the drill string tends to lie on the lower side of the wellbore and drill cuttings tend to settle and accumulate along the lower side of the wellbore about the drill string. This condition of having drill cuttings lying along the lower side of the wellbore about the drill string along with the usual filter cake on the wellbore wall presents conditions susceptible for differential sticking of the drill pipe when a porous formation is penetrated that has internal pressures less than the pressures existing in the borehole.

This settling of cuttings is particularly significant in the near horizontal holes expected to be drilled in extended reach drilling. Present drill strings of drill pipe body, tool joints and drill collars are usually round and rotate concentrically about a common axis. If the pipe rotates concentrically around the same axis as the tool joints which are normally positioned against the solid wall and act as bearings for the rotating string, then a long "keyseat" is developed as the pipe is buried and beds itself into the cuttings and wall cake. A similar action of a drill string rotating about a concentric axis in a thick wall cake in a vertical hole could produce the same results. If differential pressure (borehole mud pressure less formation pore pressure) exists opposite a permeable zone in the formation, then conditions in both cases are set for the pipe to become differentially wall stuck. In both cases, the pipe is partially buried and bedded into a mass of solids, and can be hydraulically sealed to such an extent that there is a substantial pressure difference in the interface of the pipe and the wall and the space in the open borehole. This hydraulic seal provides an area on the pipe for the pressure differential to force the pipe hard against the wall. The frictional resistance to movement of the pipe against the wall causes the pipe to become immovable, and the pipe is in a state which is commonly referred to as differentially stuck.

2. Discussion of the Prior Art

Pressure-differential sticking of a drill pipe is also discussed in a paper entitled "Pressure-Differential Sticking of Drill Pipe and How It Can Be Avoided Or Relieved" by W. E. Helmick and A. J. Longley, presented at the Spring Meeting of the Pacific Coast District, Division of Production, Los Angeles, Cal., in May 1957. This paper states that the theory of pressure-differential sticking was first suggested when it was noted that spotting of oil would free pipe that had stuck while remaining motionless opposite a permeable bed. This was particularly noticeable in a field wherein a depleted zone at 4300 feet with a pressure gradient of 0.035 psi per foot was penetrated by directional holes with mud having hydrostatic gradients of 0.52 psi per foot. In view thereof, it was concluded that the drill collars lay against the filter cake on the low side of the hole, and that the pressure differential acted against the area of the pipe in contact with the isolated cake with sufficient force that a direct pull could not effect release. This paper notes that methods of effecting the release of such a pipe include the use of spotting oil to wet the pipe, thereby relieving the differential pressure, or the step of washing with water to lower the pressure differential by reducing the hydrostatic head. Field application of the principles found in a study discussed in this paper demonstrate that the best manner for dealing with differential sticking is to prevent it by the use of drill collar stabilizers or, more importantly, by intentionally shortening the intervals of time when pipe is at rest opposite permeable formations.

Fox U.S. Pat. No. 3,146,611 discloses tubular drill string members formed with grooves along continuous paths which are designed to reduce the area of periphery engagement with the wellbore and thereby lessen the likelihood of the members becoming stuck due to a pressure differential.

William Jr. U.S. Pat. No. 3,306,378 describes special drill collars used in a drill string for boring holes which are designed to maintain a stiff stem above the drill bit to counteract the tendency of the drill collars to flex and corkscrew and thus increase the drilling weight without causing a deviation of the bit. In this approach drill collars having an eccentric hole therethrough are connected with the drill pipe by means of tool joint connections on the ends thereof such that the drill collars gyrate in continuous contact with the borehole wall. Two or more collars are arranged symmetrically about the axis of rotation to maintain a uniformity of support on the wall of the borehole and also to provide the stiffness required to maintain linear alignment of the bit with respect to the axis of rotation.

Williams Jr. U.S. Pat. No. 3,382,938 describes another method for controlling deviation of a drill bit from its intended course by providing drill collars which carry a series of spaced-apart pads extending radially from one side of the collar and having faces in wiping contact with the wall of the borehole.

Dunn U.S. Pat. No. 2,841,366 discloses a method and apparatus for drilling wells which are concerned with controlling and stabilizing the drill collars and bit at the lower end of a drill string. The action of the drill collars and bit is controlled and stabilized by the provision of an eccentric weight. At a point where the drill collars tend to buckle and bend, a drill collar is provided that has generally aligned upper and lower coupling portions and an eccentric intermediate portion. The eccentric intermediate portion swings by action of centrifugal force in a circular path around the wellbore, and has a wiping engagement with the side of the wellbore which tends to smooth the wall thereof. As the eccentric portion revolves, the aligned portions are held concentric with the central axis of the wellbore and hold the drill bit vertically disposed such that the earth is penetrated in a manner to produce a straight, vertical bore.

Arnold U.S. Pat. No. 3,391,749 discusses a technique for preventing a well borehole from deviating from the vertical as it is being drilled by using a drill collar which is eccentrically weighted with respect to its axis of rotation.

Sanders U.S. Pat. No. 2,309,791 discloses a method and apparatus for cementing casing in a well wherein the casing is pushed away from the walls thereof. Stringers of mud which tend to remain in place as cement slurry flows upwardly around the casing and are broken up so that the casing is completely surrounded by cement. The casing is provided with eccentric enlargements. Either by orientation of such enlargements with respect to the casing or rotation of the casing, or by a combination of the two, the casing tends to be centered in the hole. These eccentric enlargements can be carried by or comprised of a coupling, shoe, float collar, or any fitting placed in the casing string. Rotation of the eccentric enlargements disturbs the flow of an ascending cement column, tending to force it around all of the sides of the casing.

Square and triangular drill collars have been used in many boreholes. However the purpose for their use was to attain stiffness of the bottom-hole assembly, not for preventing differential wall sticking. Spiral grooves have also been used for preventing differential wall sticking. However, spiral grooves are not similar to the out-of-round cross-sectional shape disclosed and taught herein.

SUMMARY OF THE INVENTION

An object of the present invention is to substantially extend the range of directionally-drilled wells in what is now termed extended reach drilling. The present invention alleviates the problem of differential sticking of a drill string in a borehole in drilling of this nature by reducing the area of contact between the drill string and the wellbore wall, and by sweeping the drill cuttings from the lower side of the wellbore into the main stream of the mudreturn flow to better remove the cuttings from the wellbore.

Accordingly, an object of the subject invention is to provide an improved method and arrangement for rotary drilling a wellbore into the earth in a manner which is designed to mitigate differential sticking of the drill string. Differential sticking of the drill string in the hole is mitigated by providing the drill string with elements having noncircular cross sectional shapes to cause a periodic opening to form between the noncircular elements and the cuttings and wall cake. The drill string elements may be sections of drill pipe, or may be tool joints, drill collars, wear knots, etc., all or some of which may be provided with noncircular cross-sectional shapes. The noncircular shapes may be triangular, square or other higher order multi-faceted shapes, or elliptical, etc. Rotation of the drill string causes a periodic opening to form between the noncircular elements and the cuttings and wall cake which results in a movement of the mass of solids around the noncircular elements to positions away from the drill string, thereby mitigating the tendency of the drill string to differentially stick. Further, hydraulic seals are also likely to be broken by the reciprocating action of the noncircular elements.

The reciprocating action of the noncircular drill string also tends to stir the drill cuttings and permits the circulating mud to contact and move then more efficiently. Rapid rotation of the noncircular drill elements fluidizes the mass of solids and breaks up gelled volumes of mud and cuttings which are then moved more efficiently by the circulating mud. Both actions, stirring and breaking up the gels, results in more effective borehole cleaning.

A particularly favorable and preferred cross-sectional shape is elliptical as the edge of the elliptical element presents a smooth face to the wall twice during each rotation and two voids rotate with the drill collar. When rotation is stopped, at least one void always exists between the drill string and the wall of any mass of accumulated solids surrounding the string.

BRIEF DESCRIPTION OF THE DRAWINGS

The foregoing and other objects and advantages of the inventive arrangement for reducing the differential pressure sticking tendency of a drill string may be more readily understood by one skilled in the art, having reference to the following detailed description of several preferred embodiments, taken in conjunction with the accompanying drawings wherein identical reference numerals refer to like elements throughout the several views, and in which.

DETAILED DESCRIPTION OF THE DRAWINGS

Figure 1:
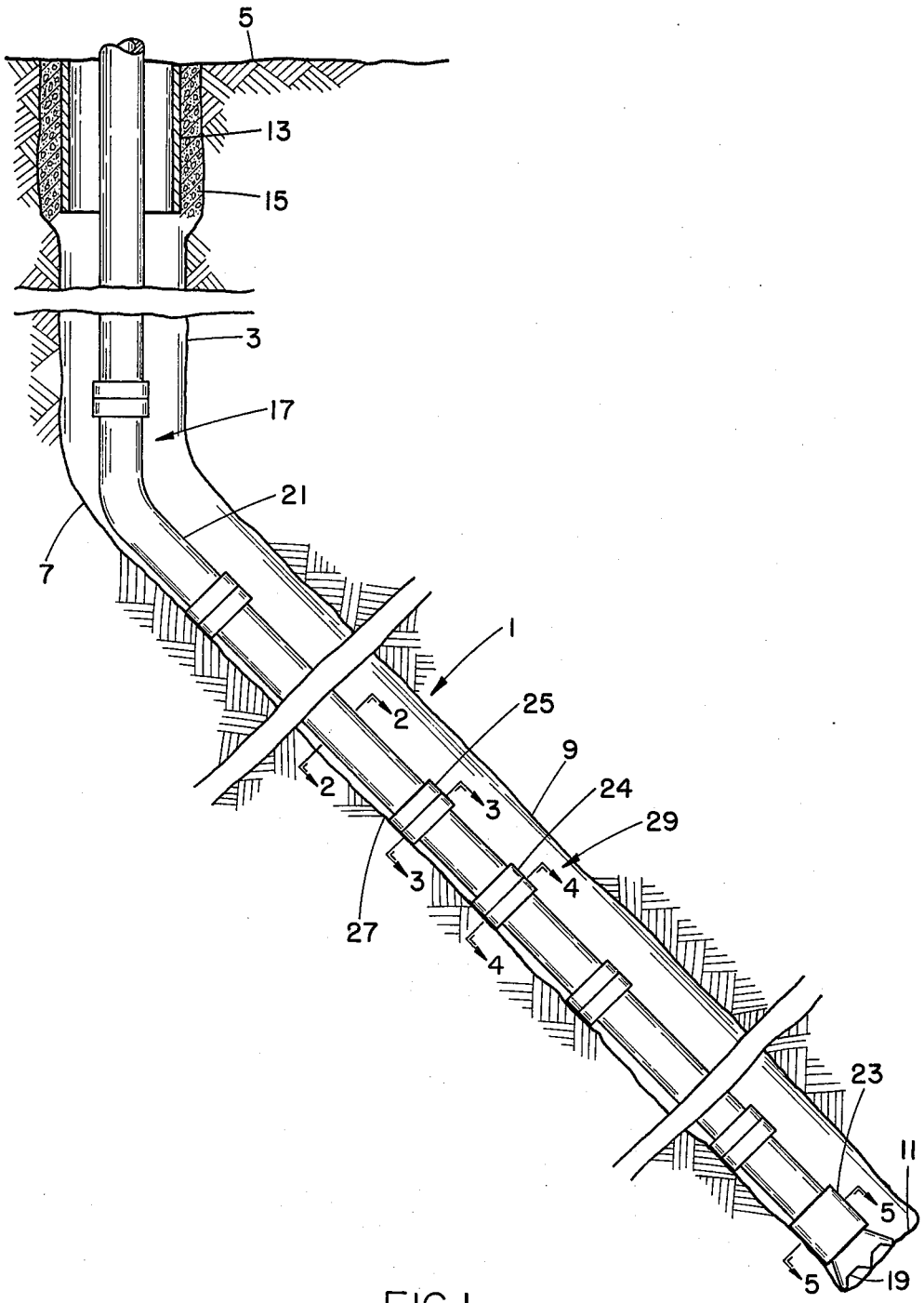
FIG. 1 is a schematic drawing of a deviated wellbore extending into the earth and illustrates several embodiments of the present invention.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, a drill pipe is always in tension during drilling operations. Drill pipe commonly varies from 3½" to 5" in outside diameter, and is normally constructed of steel. However, aluminum drill pipe is also available commercially, and may be an attractive option for extended reach drilling as it would reduce the weight of the drill string against the side of a high angle hole.

Commercially available 4½ inch aluminum drill pipe with steel tool joints should exert only about one third of the wall force due to gravity on the low side of an inclined hole in a 14 ppg mud as a similar steel drill string. Theoretically, for frictional forces, one third the wall force would then produce one third the drag and one third the torque of a comparable steel pipe string. Moreover, a commercial aluminum drill string compares favorably with a steel drill string regarding other physical properties.

Drill collars are thick-walled pipe compared to drill pipe and thus are heavier per linear foot than drill pipe. Drill collars act as stiff members in the drill string, and are normally installed in the drill string immediately above the bit and serve to supply weight on the bit. In common rotary drilling techniques, only the bottom three-fourths of the drill collars are in axial compression to load the bit during drilling, while about the top one-fourth of the drill collars are in tension, as is the drill pipe. The drill collars used in conducting rotary drilling techniques are of larger diameter than the drill pipe in use, and normally are within the range of 4½" to 10" in outside diameter.

Tool joints are connectors for interconnecting joints of drill pipe, and are separate components that are attached to the drill pipe after its manufacture. A tool joint is comprised of a male half or pin end that is fastened to one end of an individual piece of pipe and a female half or box end that is fastened to the other end. Generally, the box-end half of a tool joint is somewhat longer than the pin-end half. A complete tool joint is thus formed upon interconnecting together a box-end half and a pin-end half of a tool joint.

In carrying out rotary drilling techniques, a drilling rig is employed which utilizes a rotary table for applying torque to the top of the drill string to rotate the drill string and the bit. The rotary drill table also acts as a base stand on which all tubulars, such as drill pipe, drill collars, and casing, are suspended in the hole from the rig floor. A kelly is used as a top tubular member in the drill string, and the kelly passes through the rotary table and is acted upon by the rotary table to apply torque through the drill string to the bit. Fluid or mud pumps are used for circulating drilling fluid or mud intermediate the drilling rig and the bottom of the wellbore. Normally, the drilling fluid is pumped down the drill string and out through the drill bit, and is returned to the surface through the annulus formed about the drill string. The drilling fluid serves such purposes as removing earth cuttings made by the drill bit from the wellbore, cooling the bit, and lubricating the drill string to lessen the energy required to rotate the drill pipe. In completing the well, casing is normally run thereinto and is cemented to maintain the casing in place.

As previously mentioned, in the drilling of wellbores utilizing rotary drilling equipment, problems known as differential sticking of the drill string are sometimes encountered. These problems become more severe in drilling deviated wellbores, particularly in extended reach drilling, inasmuch as the drill string lies on the bottom of the deviated portion of the wellbore and drill cuttings tend to settle about the drill string. Because the drill string and cuttings lay along the bottom of the deviated portion of the wellbore, that portion of the annulus that lies above the drill string serves as the main stream for the flow of the drilling mud and cuttings to the surface of the earth.

Referring to the drawings in detail, particularly with reference to FIG. 1, a deviated wellbore 1 has a vertical first portion 3 which extends from the surface 5 of the earth to a kick-off point 7 and a deviated second portion 9 of the wellbore which extends from the kick-off point 7 to the wellbore bottom 11. Although the illustrated embodiment shows a wellbore having a first vertical section extending to a kick-off point, the teachings of the present invention are applicable to other types of wellbores as well. For instance, under certain types of drilling conditions involving porous formation and large pressure differentials, the teachings herein may be applicable to vertical wellbores. Also, some deviated wellbores need not have the first vertical section illustrated in FIG. 1. A shallow or surface casing string 13 is shown in the wellbore surrounded by a cement sheath 15.

A drill string 17, having a drill bit 19 at the lower end thereof, is shown in the wellbore 1. The drill string 17 is comprised of drill pipe 21 and the drill bit 19, and will normally include drill collars 23. The drill pipe 21 is comprised of joints of pipe that are interconnected together by tool joints 25, and the drill string may also include wear knots 24 for their normal function. The tool joints 25 in the deviated second portion 9 of the wellbore normally rest on the lower side 27 of the wellbore, and support the drill pipe 21 above the lower side of the wellbore.

In drilling of the wellbore, drilling fluid (not shown) is circulated down the drill string 17, out the drill bit 19, and returned via the annulus 29 of the wellbore to the surface 5 of the earth. Drill cuttings formed by the breaking of the earth by the drill bit 19 are carried by the returning drilling fluid in the annulus 29 to the surface of the earth. These drill cuttings (not shown) tend to settle along the lower side 27 of the wellbore about the drill pipe 21.

In accordance with the teachings of the present invention the drill string elements, such as the drill pipe 21, the tool joints 25, the drill collars 23, and the wear knots 24 etc. are provided with noncircular cross-sectional shapes. The noncircular shapes may be triangular, square or other higher order multi-faceted shapes, or elliptical, etc. Rotation of the drill string causes a periodic opening to form between the noncircular elements and the cuttings and wall cake which results in a movement of the mass of solids around the noncircular elements to positions away from the drill string, thereby mitigating the tendency of the drill string to differentially stick. Further, hydraulic seals are also likely to be broken by the reciprocating action of the noncircular elements.

Figure 2:
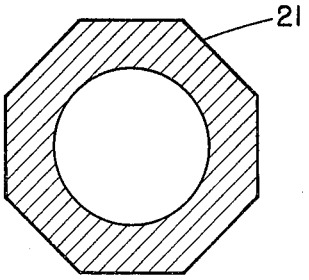
FIG. 2 is a sectional view drawn through line 2—2 in FIG. 1, and shows the octagonal cross sectional shape of a length of drill pipe.
Figure 4:
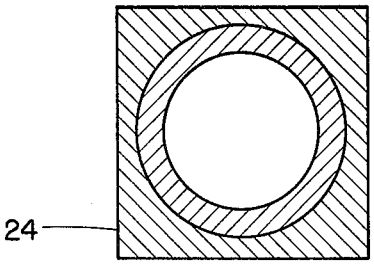
FIG. 4 is a sectional view drawn through line 4—4 in FIG. 1, and illustrates a wear knot having a square cross sectional shape.

In greater particularity, FIG. 2 is a sectional view drawn through line 2—2 in a length of drill pipe 21, and illustrates the pipe having an octagonal cross section. The tool joints 25 may also be constructed with noncircular cross sections as shown by the elliptical cross section of tool joint 25 in FIG. 3. The drill collars 23 may also be constructed with noncircular cross sections as shown by the elliptical shape of collar 23 in FIG. 5. If the drill string includes wear knots 24, they also may have a nonround shape as illustrated by the square wear knot 24 in FIG. 4.

The reciprocating action of the noncircular drill elements tends to stir the drill cuttings and permits the circulating mud to contact and move them more efficiently. Rapid rotation of the noncircular drill elements fluidizes the mass of solids and breaks up gelled volumes of mud and cuttings which are then moved more efficiently by the circulating mud. Both actions, stirring and breaking up the gels, results in more effective borehole cleaning.

Figure 3:
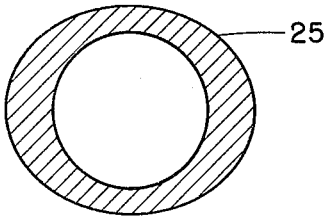
FIG. 3 illustrates a sectional view taken along line 3—3 in FIg. 1, and shows an elliptical cross sectional shape for a tool joint.
Figure 5:
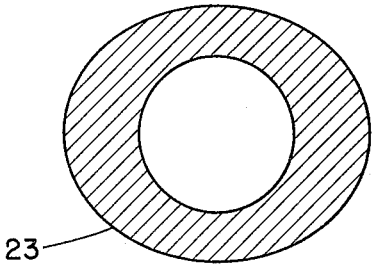
FIG. 5 illustrates a sectional view taken along line 5—5 in FIG. 1, and shows a drill collar having an elliptical cross sectional shape.

A particularly favorable and preferred cross-sectional shape is elliptical as shown in FIGS. 3 and 5, as the edge of the elliptical element presents a smooth face to the wall twice during each rotation and two voids rotate with the drill collar. When rotation is stopped, at least one void always exists between the drill string and the wall of any mass of accumulated solids surrounding the string.

While several embodiments of the present invention have been described in detail herein, it should be apparent to one of ordinary skilled in the rotary drilling arts, that the present disclosure and teachings will suggest many other embodiments and variations to the skilled artisan. For instance, the teachings herein are also applicable to special drill string devices such as subs, measurement devices, and casing protectors.

This invention is directed to mitigating the differential sticking of a drill string by preventing the drill pipe from lying directly against the lower side of the wellbore and by eccentrically moving the drill string, and in particular the drill pipe, about the wellbore to stir or sweep the drill cuttings from the lower side of the wellbore into the main stream of flow of the drilling mud to better remove the cuttings therefrom.

By this invention there is provided a method of drilling a wellbore into the earth's crust by a rotary drilling technique wherein a drill string is used to advance a drill bit into the earth's crust and a drilling fluid is circulated down the drill string, out the drill bit, and returned from the wellbore via the annulus formed about the drill string. In the drilling of such a wellbore it is usual after drilling the first few hundred or few thousand feet to install and cement in place a first string of casing often referred to as "shallow or surface casing" and thereafter to continue drilling the wellbore in an open hole. Subsequent strings of casing may be run and cemented into place and drilling continued in an open hole below such casing. In accordance with this invention, a drill string is used in the open hole portion of the wellbore which is comprised of joints of drill pipe connected together with nonconcentric or eccentric connectors known as and hereafter referred to as eccentric "tool joints".

This invention is particularly applicable for drilling a deviated wellbore. In the drilling of a deviated wellbore by the method of this invention, there is drilled a vertical first portion of the wellbore into the earth's crust from a surface location to a kick-off point at about the lower end of the first portion by rotating and advancing a drill string and drill bit into the earth's crust and a deviated second portion of the wellbore is initiated at the kick-off point. Thereafter, the drill string and drill bit are withdrawn from the wellbore. Casing may be installed and cemented therein as desired. A specialized drill string is then run into the vertical first portion of the wellbore for drilling the deviated second portion thereof, which specialized drill string is comprised of joints of drill pipe connected one to the other with eccentric tool joints to provide for the body of the drill pipe to be nonconcentric with the tool joints, which drill string has a drill bit connected at the lower end thereof. The specialized drill string is rotated to drill the deviated second portion of the wellbore and to eccentrically move the drill pipe in the wellbore to sweep earth cuttings from the lower side of the deviated second portion thereof and to prevent differential sticking of the specialized drill string in the wellbore.

The eccentric portion of the tool joints may be positioned along the drill pipe in a random manner. In accordance with one embodiment of this invention, the drill pipe is connected one joint to the other with eccentric tool joints arranged in alternate pairs, with each pair having the eccentric of one tool joint thereof in angular alignment with the eccentric of the other tool joint and with each alternate pair being aligned such that the eccentric of the tool joints of the alternate pair is aligned about 180° with the eccentric alignment of the next adjacent alternate pair of tool joints. In accordance with another embodiment of this invention, all of the eccentrics of the tool joints are aligned one with the other along the drill pipe.

Figure 6:
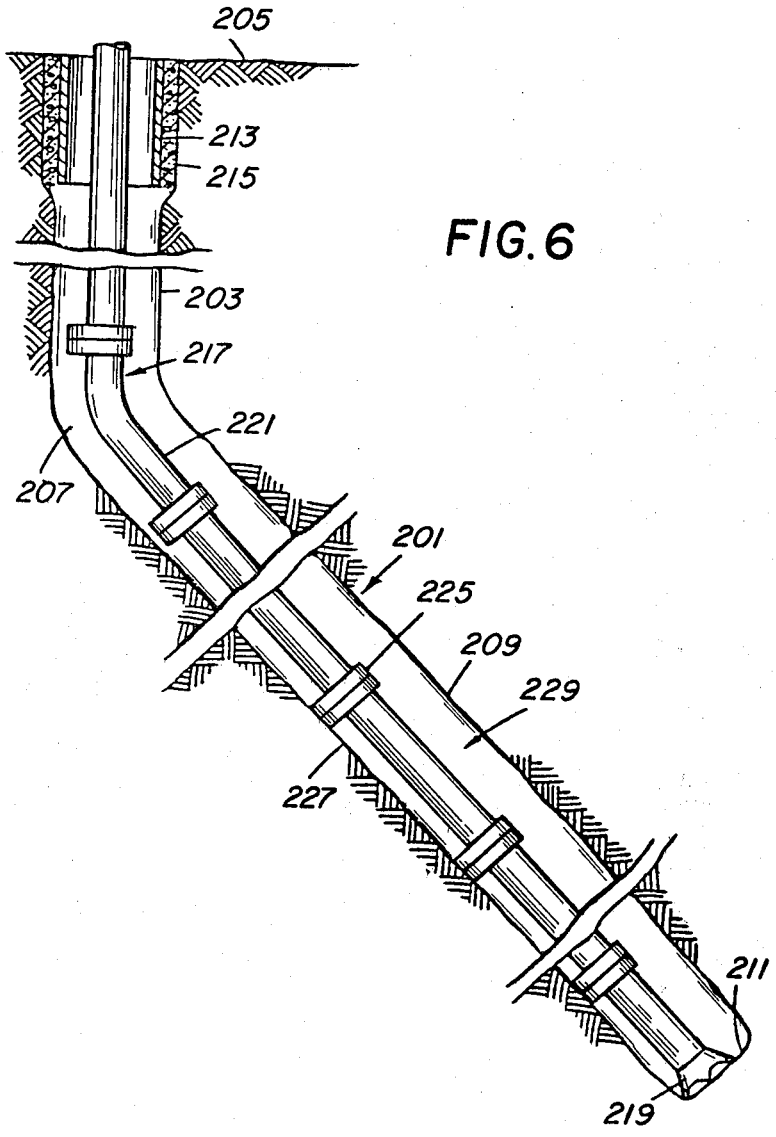
FIG. 6 is a schematic drawing of a deviated wellbore extending into the earth and illustrating the present invention.

This invention is hereafter described in more detail by reference to the drawings. With reference to FIG. 6 there is shown a deviated wellbore 201 having a vertical first portion 203 that extends from the surface 205 of the earth to a kick-off point 207 and a deviated second portion 209 of the wellbore which extends from the kick-off point 207 to the wellbore bottom 211. A shallow or surface casing string 213 is shown in the wellbore surrounded by a cement sheath 215. A drill string 217, having a drill bit 219 at the lower end thereof, is shown in the wellbore 201. The drill string 217 is comprised of drill pipe 221 and the drill bit 219, and will normally include drill collars (not shown). The drill pipe 221 is comprised of joints of pipe that are interconnected together by eccentric tool joints 225. Eccentric tool joints may be used to connect the joints of drill pipe located in the vertical first portion 203 of the wellbore extending in the open hole portion thereof below the casing 213 as well as in the deviated second portion 209 of the wellbore. The eccentric tool joints 225 in the deviated second portion 209 of the wellbore rest on the lower side 227 of the wellbore and support the drill pipe 221 above the lower side 227 of the wellbore.

In the drilling of the wellbore, drilling fluid (not shown) is circulated down the drill string 217, out the drill bit 219, and returned via the annulus 229 of the wellbore to the surface 205 of the earth. Drill cuttings formed by the breaking of the earth by the drill bit 219 are carried by the returning drilling fluid in the annulus 229 to the surface of the earth. These drill cuttings (not shown) tend to settle along the lower side 227 of the wellbore about the drill pipe 221. The eccentric tool points 225 rest on the lower side 227 of the wellbore and support the drill pipe 221 above most of these cuttings. During drill operations, the drill string 217 is rotated and the rotation of the eccentric tool joints 225 causes the drill pipe 221 to be eccentrically moved in the wellbore. This movement of the drill pipe 221 tends to sweep the drill cuttings (not shown) from the lower side of the wellbore 227 into the main stream of flow of the returning drilling fluid in the annulus 229, and in particular into that part of the annulus which lies around the upper side of the drill pipe 221, where they are better carried by the returning drilling fluid to the surface of the earth. The main stream of flow is illustrated schematically by an enlarged wellbore about the upper side of the drill pipe 221 and drill bit 219. The use of the eccentric tool joints 225 in the manner described by this invention mitigates the problem of differential sticking of the drill string by eccentrically moving the drill pipe 221 in the wellbore and by keeping the wellbore clean.

Figures 7, 8A, 8B:
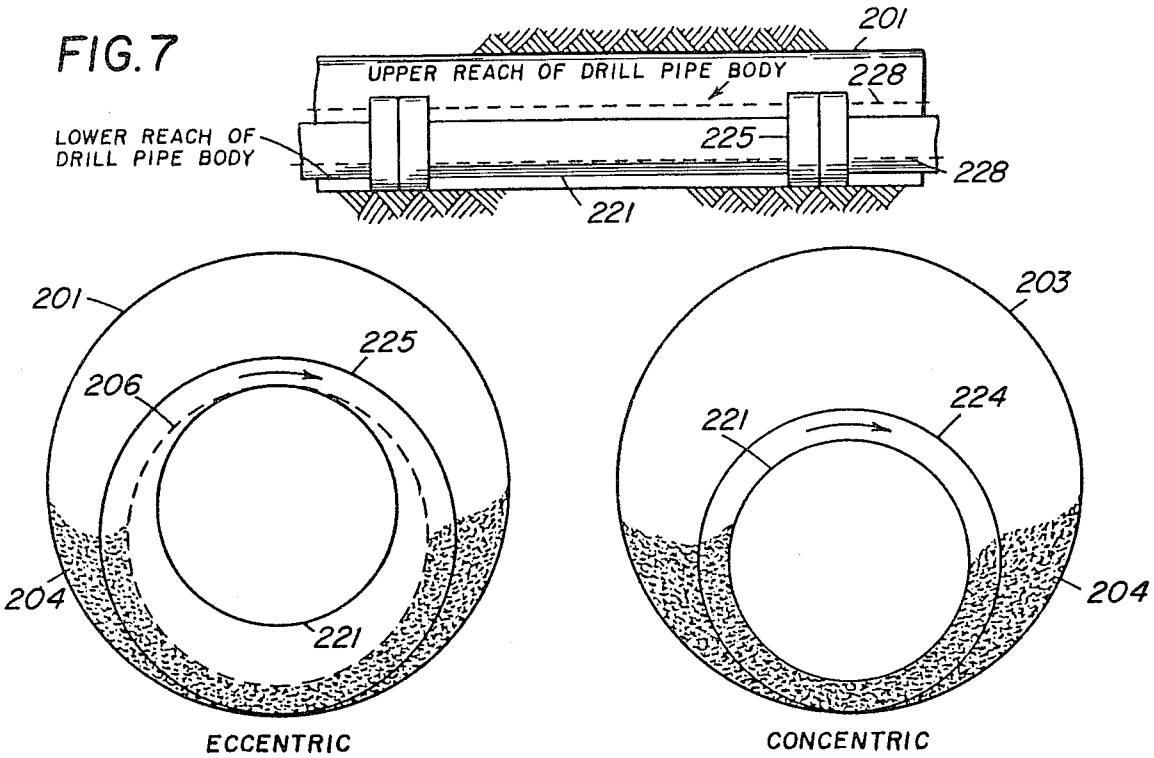
FIG. 7 is a schematic drawing illustrating joints of drill pipe interconnected by eccentric tool joints and positioned along the lower side of a deviated portion of a wellbore.
FIGS. 8A and 8B show schematic cross-sectional views of drill pipe connected by eccentric and concentric tool joints and illustrate the wellbore-cleaning effects of the present invention.

With reference to FIG. 7 the action of the drill pipe 221 brought about by rotation of the drill string in the wellbore 201 where joints of drill pipe are interconnected by eccentric tool joints 225 is further illustrated. There shown in solid lines is the location at the lower reach of the drill pipe 221 in a deviated portion of the borehole 201 where the joints of the drill pipe are interconnected by eccentric tool joints 225 and where adjacent tool joints 225 are aligned such that the eccentric portions of the adjacent tool joints are in angular alignment and where the eccentric tool joints are rotated in the borehole 201 to provide for the drill pipe 221 to be at the lowest position of the pipe body. The dotted lines 228 show the position of the drill pipe body 221 when the eccentric tool joints 225 are rotated such that the body of the drill pipe is at the highest position in the deviated portion of the wellbore 201. From this FIG. 7 it is readily seen that, upon rotation of the drill pipe 221 interconnected with eccentric tool joints in a deviated wellbore, the drill pipe 221 moves upwardly and downwardly in the borehole 201 with each successive rotation of the drill string.

With reference to FIGS. 8A and 8B, there is shown schematically the movement which would take place upon rotation in a borehole of a drill pipe interconnected by eccentric joints as compared to the movement which drill pipe would take in a borehole by rotation of the drill pipe interconnected by concentric tool joints. With reference first to FIG. 8A, there is shown the case where eccentric tool joints are used. There shown in a cross-sectional schematic view in a wellbore 201 having drill pipe 221 located therein and interconnected by eccentric tool joints 225. Drill cuttings 204 are shown in the lower side of the borehole 201 which indicate how the drill cuttings accumulate along the lower side of a deviated borehole. The dotted line 206 shows a trace that the drill pipe 221 would follow during the rotation of the drill pipe interconnected by eccentric tool joints 225. The position of the drill pipe 221 as represented by the solid circle corresponds to the position of FIG. 7 where the drill pipe body is located at the upper reach of the pipe body.

With reference to FIG. 8B, the drill cuttings 204 are again shown in the borehole 201. The drill pipe 221 is shown in concentric, axial alignment with concentric tool joints 224 of the type generally used in conducting rotary drilling techniques. By comparison of these two figures it is seen that the use of eccentric tool joints results in movement of the drill pipe 221 along an eccentric path 206 upon rotation of the tool joints and drill pipe which results in stirring and sweeping drill cuttings 204 from the lower portion of the wellbore and results in continually moving the drill pipe eccentrically upward and downward in the borehole 201. This movement of the pipe tends to stir and sweep the drill cuttings 204 into the flowing mud stream in the annulus of a wellbore and thereby better removes these cuttings from the wellbore. The removal of the cuttings from the wellbore greatly lessens the change of differentially sticking the drill pipe. In FIG. 8B there is shown in contrast, the normal situation where concentric tool joints are used with drill pipe.

What is claimed is:

1. A method of drilling a deviated wellbore into the earth's crust by a rotary drilling technique wherein a drill string is used to advance a drill bit into the earth's crust and a drilling fluid is circulated down the drill string and returned from the wellbore in the annulus formed about the drill string, comprising:

(a) drilling a vertical first portion of said wellbore into the earth's crust from a surface location to a kick-off point at about the lower end of said first portion by rotating and advancing a drill string and drill bit into said earth's crust;

(b) initiating a deviated second portion of said wellbore at said kick-off point;

(c) withdrawing said drill string and drill bit from said vertical first portion of said wellbore;

(d) running into said vertical first portion of said wellbore a specialized drill string for drilling said deviated second portion of said wellbore, said specialized drill string being comprised of elements having non-circular cross-sectional shapes, said drill string having a drill bit at the lower end thereof; and (e) rotating said specialized drill string to drill said deviated second portion of said wellbore, whereby the reciprocating action of said non-circular elements tends to stir earth cuttings and to permit said drilling fluid to contact and move earth cuttings to thereby mitigate differential sticking of said specialized drill string in said wellbore.

2. The method of claim 1 wherein said deviated second portion has an angle from the vertical of at least 60°.

3. The method of claim 1 wherein said non-circular elements have elliptical cross-sectional shapes.

4. The method of claim 1 wherein said elements are sections of drill pipe, tool joints, drill collars or wear knots.

5. The method of claim 1 wherein said specialized drill string is comprised of joints of drill pipe connected one to the other with eccentric tool joints to provide for the body of the drill pipe to be nonconcentric with said tool joints.

6. The method of claim 5 wherein said specialized drill string is comprised of joints of drill pipe connected one to the other with eccentric tool joints arranged in alternate pairs with each pair having the eccentric of one tool joint thereof in angular alignment with the eccentric of the other tool joint and each alternate pair being aligned such that the eccentric of the tool joints of said alternate pair is aligned about 180° with eccentric alignment of the next adjacent alternate pair of tool joints.

* * * * *